US010450800B2

(12) United States Patent
Clouzeau et al.

(10) Patent No.: US 10,450,800 B2
(45) Date of Patent: Oct. 22, 2019

(54) BEARING/GEARING SECTION FOR A PDM ROTOR/STATOR

(75) Inventors: Francois Clouzeau, Cheltenham (GB); Maxim Pushkarev, Katy, TX (US); Lance D. Underwood, Morrison, CO (US); Bassam Mansour, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 262 days.

(21) Appl. No.: 14/003,299

(22) PCT Filed: Mar. 8, 2012

(86) PCT No.: PCT/US2012/028153
§ 371 (c)(1),
(2), (4) Date: Feb. 13, 2014

(87) PCT Pub. No.: WO2012/122321
PCT Pub. Date: Sep. 13, 2012

(65) Prior Publication Data

US 2014/0170011 A1 Jun. 19, 2014

Related U.S. Application Data

(63) Continuation of application No. 13/414,043, filed on Mar. 7, 2012, now abandoned.
(Continued)

(51) Int. Cl.
*F04C 2/107* (2006.01)
*E21B 4/02* (2006.01)
(Continued)

(52) U.S. Cl.
CPC ..... *E21B 4/02* (2013.01); *E21B 43/121* (2013.01); *F01C 1/107* (2013.01); *F03C 2/08* (2013.01); *F04C 2/1075* (2013.01); *F04C 13/008* (2013.01)

(58) Field of Classification Search
CPC ..... F01C 1/107; F04C 2/075; F04C 13/008; F04C 2/1075; F04C 2/1071; F04C 2/1073; E21B 4/02; E21B 43/121; F03C 2/08
(Continued)

(56) References Cited

U.S. PATENT DOCUMENTS 3,912,426 A 10/1975 Tschirky
3,982,858 A 9/1976 Tschirky
(Continued)

FOREIGN PATENT DOCUMENTS

DE 102008036511 A1 2/2010
RU 2073094 C1 2/1997

OTHER PUBLICATIONS

PCM Moineau Catolgue, Sep. 28, 2010.*
(Continued)

*Primary Examiner* — Deming Wan

(57) ABSTRACT

A moving or progressive cavity motor or pump is disclosed, the motor including a rotor and a stator, the stator having one or more inserts or gearing sections to limit a lateral movement of the rotor relative to the stator. In some embodiments, the motor or pump may include a rotor and a stator, the stator including: a first, helicoidal, section comprising a compliant material having a first compressibility; a second section, helicoidal, non-helicoidal, or combination thereof, having a second compressibility, wherein the second compressibility is less than the first compressibility.

20 Claims, 12 Drawing Sheets

Related U.S. Application Data

(60) Provisional application No. 61/450,239, filed on Mar. 8, 2011.

(51) Int. Cl.

| | |
|---|---|
| ***E21B 43/12*** | (2006.01) |
| ***F01C 1/107*** | (2006.01) |
| ***F04C 13/00*** | (2006.01) |
| ***F03C 2/08*** | (2006.01) |

(58) Field of Classification Search
USPC ..... 418/48, 45, 201.1, 152, 153
See application file for complete search history.

(56) References Cited

U.S. PATENT DOCUMENTS

| | | | | |
|---|---|---|---|---|
| 4,585,401 | A * | 4/1986 | Baldenko | E21B 4/02 29/434 |
| 5,145,342 | A * | 9/1992 | Gruber | F04C 2/1075 418/153 |
| 6,170,572 | B1 * | 1/2001 | Fulbright | B29C 33/304 166/105 |
| 6,241,494 | B1 * | 6/2001 | Pafitis | E21B 4/02 175/107 |
| 6,568,076 | B2 * | 5/2003 | Bottos | F04C 2/1075 29/888.02 |
| 7,214,042 | B2 * | 5/2007 | Parrett | F04B 15/02 418/152 |
| 8,613,608 | B2 * | 12/2013 | Ree | 418/161 |
| 9,051,780 | B2 * | 6/2015 | Trushin | E21B 4/02 |
| 2006/0182644 | A1 | 8/2006 | Delpassand et al. | |
| 2008/0085203 | A1 * | 4/2008 | Amburgey | F04C 2/1076 418/48 |
| 2008/0304992 | A1 | 12/2008 | Hooper et al. | |
| 2010/0284843 | A1 * | 11/2010 | Jager | 418/48 |
| 2015/0078943 | A1 * | 3/2015 | Gunter | F04C 2/1075 418/1 |

OTHER PUBLICATIONS

International Search Report for PCT Application Serial No. PCT/US2012/028153 dated Dec. 26, 2012.

Office Action issued in related RU application 2013144936 dated Apr. 6, 2015, 7 pages.

Extended European Search Report issued in related EP application 12754497.1 dated Jun. 26, 2015, 6 pages.

International Preliminary Report on Patentability issued in the International Patent Application PCT/US2012/028153 dated Sep. 10, 2013, 5 pages.

Examination Report 94(3) EPC issued in related EP application 12754497.1 dated Dec. 15, 2016, 5 pages.

* cited by examiner

BEARING/GEARING SECTION FOR A PDM ROTOR/STATOR

FIELD OF THE DISCLOSURE

Embodiments disclosed herein relate generally to Moineau pumps and motors, inclusive of positive displacement or progressive cavity motors and pumps. Embodiments disclosed herein relate to downhole motors and pumps used when drilling the bore of a subterranean well. More particularly, embodiments disclosed herein relate to improving motor or pump efficiency and reducing stator wear.

BACKGROUND

Boreholes are frequently drilled into the Earth's formation to recover deposits of hydrocarbons and other desirable materials trapped beneath the Earth's surface. Traditionally, a well is drilled using a drill bit attached to the lower end of what is known in the art as a drillstring. The drillstring is traditionally a long string of sections of drill pipe that are connected together end-to-end through rotary threaded pipe connections. The drillstring is rotated by a drilling rig at the surface thereby rotating the attached drill bit. Drilling fluid, or mud, is typically pumped down through the bore of the drillstring and exits through ports at the drill bit. The drilling fluid acts both to lubricate and cool the drill bit as well as to carry cuttings back to the surface. Typically, drilling mud is pumped from the surface to the drill bit through the bore of the drillstring, and is allowed to return with the cuttings through the annulus formed between the drillstring and the drilled borehole wall. At the surface, the drilling fluid is filtered to remove the cuttings and is often recycled.

In typical drilling operations, a drilling rig and rotary table are used to rotate a drillstring to drill a borehole through the subterranean formations that may contain oil and gas deposits. At the downhole end of the drillstring is a collection of drilling tools and measurement devices commonly known as a Bottom Hole Assembly (BHA). Typically, the BHA includes the drill bit, any directional or formation measurement tools, deviated drilling mechanisms, mud motors, and weight collars that are used in the drilling operation. A measurement while drilling (MWD) or logging while drilling (LWD) collar is often positioned just above the drill bit to take measurements relating to the properties of the formation as the borehole is being drilled. Measurements recorded from MWD and LWD systems may be transmitted to the surface in real-time using a variety of methods known to those skilled in the art. Once received, these measurements will enable those at the surface to make decisions concerning the drilling operation. For the purposes of this application, the term MWD is used to refer either to an MWD (sometimes called a directional) system or an LWD (sometimes called a formation evaluation) system. Those having ordinary skill in the art will realize that there are differences between these two types of systems.

A popular form of drilling is called "directional drilling." Directional drilling is the intentional deviation of the wellbore from the path it would naturally take. In other words, directional drilling is the steering of the drill string so that it travels in a desired direction. Directional drilling can be advantageous offshore because it enables several wells to be drilled from a single platform. Directional drilling also enables horizontal drilling through a reservoir. Horizontal drilling enables a longer length of the wellbore to traverse the reservoir, which may increase the production rate from the well. A directional drilling system may also be beneficial in situations where a vertical wellbore is desired. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A traditional method of directional drilling uses a BHA that includes a bent housing and a positive displacement motor (PDM) or mud motor. The bent housing includes an upper section and a lower section formed on the same section of drill pipe, but are separated by a bend in the pipe. Instead of rotating the drillstring from the surface, the drill bit in a bent housing drilling apparatus is pointed in the desired drilling direction, and the drill bit is rotated by a mud motor located in the BHA.

A mud motor converts some of the energy of the mud flowing down through the drill pipe into a rotational motion that drives the drill bit. Thus, by maintaining the bent housing at the same azimuth relative to the borehole, the drill bit will drill in a desired direction. When straight drilling is desired, the entire drill string, including the bent housing, is rotated from the surface. The drill bit may angulate with the bent housing and drills a slightly overbore, but straight, borehole.

Positive displacement motor (PDM) power sections include a metal (typically steel) rotor and a stator. The stator is typically a steel tube with rubber molded in into a multi-lobed, helixed profile in the interior. The stator tube may be cylindrical inside (having a solid rubber insert of varying thickness), or may have a similar multi-lobed, helixed profile machined into the interior so that the molded-in rubber is substantially uniform thickness (i.e. "even wall"). Power sections, whether solid rubber or even-wall, are typically uniform throughout the length of the power section. That is, they are either all-rubber or all-even-wall over the entire length of the multi-lobed profile.

Motor failure during directional drilling can be a significant and undesirable event. One mode of motor failure is rubber chunking. Elastomeric materials in the mud motor provide a seal between the rotor and the stator. Without this seal, the motor does not operate efficiently and may fail altogether. In mud motors, as they currently exist, the elastomer sustains undesirable lateral forces between the rotor and the stator as the rotor turns. It may be desirable to determine a way to reduce or eliminate the excessive lateral forces sustained by the elastomer.

It has been observed that the majority of chunking happens on the down hole part of the rubber lining. The second main chunking occurrence is at the up and down hole portions on the same stator. Potential causes of this chunking have been hypothesized as aggressive differential pressures, motor stalling, junk damage, poor rotor/stator matching, and elastomer quality degradation.

These potential causes do not explain why most of the chunking happens or starts mainly on the bottom portion of the stator. One potential explanation for this pattern is the concentrated presence of side forces on the rubber at the downhole part followed by the uphole part of stator. Potential contributing factors for the concentrated side force at the bottom of the stator during drilling of curve section may include: side forces resulting from the bending of motor section to fit in the directional hole; side force resulting from the combined effect of hydraulic thrust on the rotor and the misalignment between the rotor axis and the transmission shaft; side force resulting from the combined effect of the torque on the rotor and the misalignment between the rotor axis and the transmission shaft; and side force resulting from inertial forces produced by the transmission shaft.

SUMMARY OF THE CLAIMED EMBODIMENTS

In one aspect, embodiments disclosed herein relate to a mud motor including a rotor and a stator. The stator has one or more inserts or gearing sections to limit a lateral movement of the rotor relative to the stator.

In another aspect, embodiments disclosed herein relate to a moving or progressive cavity motor or pump. The motor or pump may include a rotor and a stator, where the stator has: a first, helicoidal section that is a compliant material having a first compressibility; and a second section, helicoidal, non-helicoidal, or combination thereof, having a second compressibility, wherein the second compressibility is less than the first compressibility.

In another aspect, embodiments disclosed herein relate to a mud motor assembly including a moving or progressive cavity motor having a proximal end and a distal end. The moving or progressive cavity motor may include: a rotor; and a stator, where the stator has: a power generating section; and a gearing section, the gearing section reacting the loads generated by the power generating section.

This summary is provided to introduce a selection of concepts that are further described below in the detailed description. This summary is not intended to identify key or essential features of the claimed subject matter, nor is it intended to be used as an aid in limiting the scope of the claimed subject matter. Other aspects and advantages will be apparent from the following description and the appended claims.

DETAILED DESCRIPTION

Embodiments disclosed herein relate generally to Moineau machines, i.e., Moineau pumps and motors, inclusive of positive displacement or progressive cavity motors and pumps. Embodiments disclosed herein relate to downhole motors and pumps used when drilling the bore of a subterranean well. More particularly, embodiments disclosed herein relate to improving motor or pump efficiency and reducing rotor and/or stator wear.

Moineau machines typically include a rotor and a stator. As used herein, "rotor" refers to the rotating portion of the motor or pump, which may be the shaft or the sheath. Similarly, "stator" refers to the stationary portion of the motor or pump, which may be the sheath or the shaft, respectively. While embodiments disclosed herein may be described with respect to a rotor (shaft) rotating within a stator (sheath), those skilled in the art should readily understand that embodiments disclosed herein may also apply where the rotor (sheath) is rotating about a stator (shaft). Additionally, those skilled in the art will appreciate that descriptions with respect to a motor, such as an output shaft, may similarly apply to pumps, such as a drive shaft. Accordingly, while portions of the description below may be discussed in relation to mud motors, embodiments herein are not limited to the described motors.

Figure 1C:
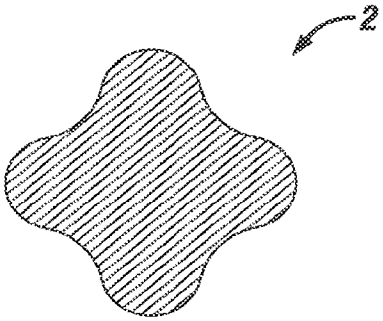
FIGS. 1A-1C illustrate sectional views of rotors useful in motors and pumps according to embodiments disclosed herein.
Figure 1B:
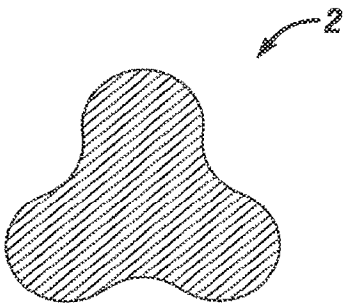
Figure 1A:
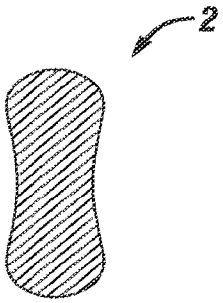
Figure 2C:
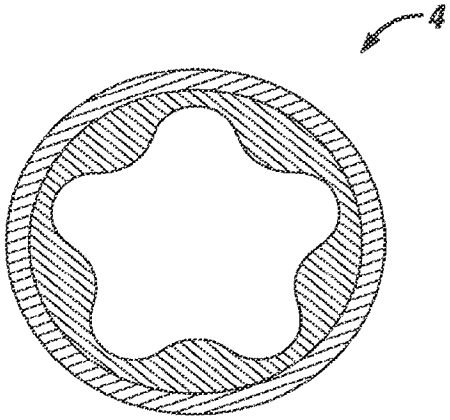
FIGS. 2A-2C illustrate sectional views of stators useful in motors and pumps according to embodiments disclosed herein.
Figure 2B:
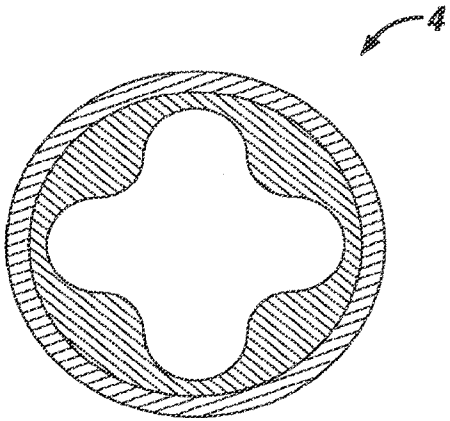
Figure 2A:
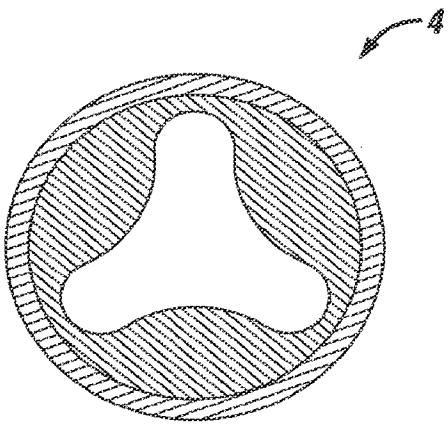

Positive displacement motors and pumps include a rotor and a stator. In order that the rotor can rotate within the stator and generate cavities that will progress in an axial direction, the profiles of both components must take specific forms. Typically, the rotor 2 will be a helically shaped shaft with a sectional shape similar to those shown in FIGS. 1A-1C. The number of lobes on the rotor 2 can vary from one to any number. The stator 4 has a profile which complements the shape of the rotor 2, with the number of lobes varying between two and any number, examples of which are illustrated in FIGS. 2A-2C. In a matching rotor-stator pair, the number of lobes on the stator 4 will be one greater than on the rotor 2. A section through a combination of rotor 2 and stator 4 is shown in FIG. 3, in which the rotor 2 has three lobes and the stator 4 has four lobes, with the rotor 2 being received within the stator 4.

Figure 3:
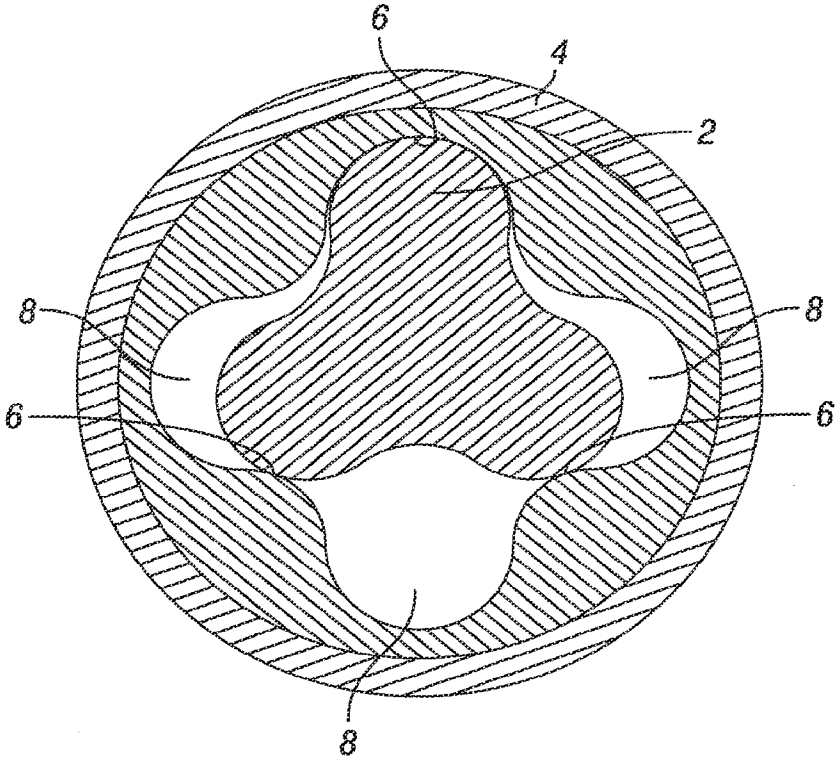
FIG. 3 shows a sectional view of a moving cavity motor or pump using the rotor of FIG. 1B and the stator of FIG. 2B.

As shown in FIGS. 1-3, the rotor has a multi-lobed, helixed profile, but with one less lobe than that of the stator. As installed in the stator, the axis of the rotor is, by design, eccentric from the stator axis. The rotor travels in a path that may be described as a precessional orbit around the axis of the stator. Looking down the power section, the rotor rotates clockwise while orbiting counter-clockwise, for example. The rotor meshes with the stator in such a way as to create cavities between the two. For fluid to pass through the cavities, the rotor must rotate. If fluid is forced through the cavities, the rotor/stator pair acts as a motor. If torque is applied to the rotor to force it to rotate, the rotor/stator pair acts as a pump. The rotor may be slightly larger than the stator, resulting in the rotor compressing the rubber during operation. The compression of the rubber, known as "interference," creates the ability for the cavities to be individually sealed and hold pressure relative to each other.

Due to their meshed multi-lobed profiles, the rotor/stator pair also serves as gears. The sealed cavities create a driving fluid force that is roughly perpendicular to the direction of rotor eccentricity at any given point in time. This force is reacted at the point where the rotor contacts the stator lobes. The two forces act as a couple, thus creating torque. The torque that is generated in the rotor in the case of the device being a motor, or required in the rotor in the case of the device being a pump, is a complex combination of the pressure forces acting in the cavities and the reaction forces between the points of contact between the stator and the rotor. This has the effect of trying to turn the rotor in the case of a motor or resisting rotation in the case of a pump. In both cases there is also a sideways force component that acts to push the rotor into the stator. The direction of this force rotates as the rotor turns. There is also a centrifugal force generated by the orbital motion of the rotor. And in the case of a motor, such as a mud motor, there may be angular and/or radial components of the thrust carried by the transmission due to the angled relationship of the rotor and drive shaft axes.

To summarize the above, there are five primary functions that the stator must accomplish in order to generate power or to pump fluid: (1) create discrete cavities, (2) seal those cavities through compression of the rubber, (3) handle radial loads due to the centrifugal force of the rotor (i.e., act as a radial bearing), (4) gear the rotor so that it must rotate when acted upon by fluid forces, and (5) withstand (react) the forces from gearing.

For a typical ("traditional") stator, the requirements of the sealing function are, in general, at odds with those of the bearing/gearing functions. To seal, the stator lobe must compress when contacted by the rotor, and thus must be flexible. To withstand loads, however, the stator lobe should be as rigid as possible to avoid excessive deflection, which may allow leakage between the individual chambers and reduce power section efficiency.

While elastomeric materials in mud motors may provide a seal between the rotor and the stator, such that the motor operates efficiently, a compression seal is not necessary. In other words, a Moineau machine does not require a compliant layer interface between the rotor and the stator; that is, the motor or pump does not require a physical interface between the shaft and the sheath. In fact, it has been found that limiting the interference between the rotor and stator, i.e., limiting the compression of the rubber, may minimize stator wear, chunking, and other failure modes. Additionally, a perfect Moineau machine may not benefit by the presence of more than a single stage. Further, the shorter the Moineau machine is, the easier it is to maintain a very tight tolerance on the mating profile of the shaft and the sheath (of the rotor and stator). Embodiments disclosed herein, providing minimal interference between the stator and rotor, or portions thereof, may provide for manufacture of essentially perfect, short Moineau machines that may be limited in length to a little more than one active full stage.

Moineau machines according to embodiments disclosed herein may include a rotor and a stator, where the stator includes a first, helicoidal section comprising a compliant material having a first compressibility and a second section, helicoidal, non-helicoidal, or combination thereof, having a second compressibility, wherein the second compressibility is less than the first compressibility. The second section may be formed from a hard plastic, rubber, composite, ceramic, or metal, providing a structural member within the stator, limiting deflection of the stator due to external loads and/or eliminating or limiting the interference between the first, compressible section of the stator and the rotor. In this manner, the sealing and structural functions of the stator may be separated, allowing the materials of each respective section to be optimized independently. The materials of the second section or sections (if more than one second section is used) may be optimized for handling mechanical loads, while the materials of the first section may be optimized for sealing, power generation, and fluid transport, including fluids that may contain solid particles, such as drilling muds.

The second section of the stator in embodiments of the motors and pumps disclosed herein may be integral with the power section, such as a section of reduced compressibility forming part of the same helicoidal profile as the first section. In other embodiments, the second section of the stator may be formed as a separate and distinct portion of the stator. Regardless of placement, the structural function of the second section may provide for limited lateral movement of the rotor relative to the stator, regardless of the relative angular position of the shaft (rotor) into the sheath (stator).

The second section, providing a structural function, may be an insert located along the length of the stator profile, where the insert provides a localized harder material to improve the durability and reliability of the Moineau machines. In other embodiments, the second section, providing the structural function, may be a separate and distinct portion of the stator, such as where the power generating function is provided by a first portion or length of the stator, and the structural, gearing function of the stator is provided by a second portion or length of the stator.

Moineau machines according to embodiments disclosed herein may include one or more relatively short (with respect to axial length of the stator) metal, composite, ceramic, or hard rubber inserts disposed at select points within the mud motor to constrain the movement of the rotor relative to the stator. This restraint may help to reduce the lateral movement of the rotor within the stator, thus reducing the undesirable lateral forces on the elastomeric materials of the stator. Because of this reduction, it may be possible to have a more efficient motor, thus reducing the length of the motor without reducing the power of the motor.

Figure 4:
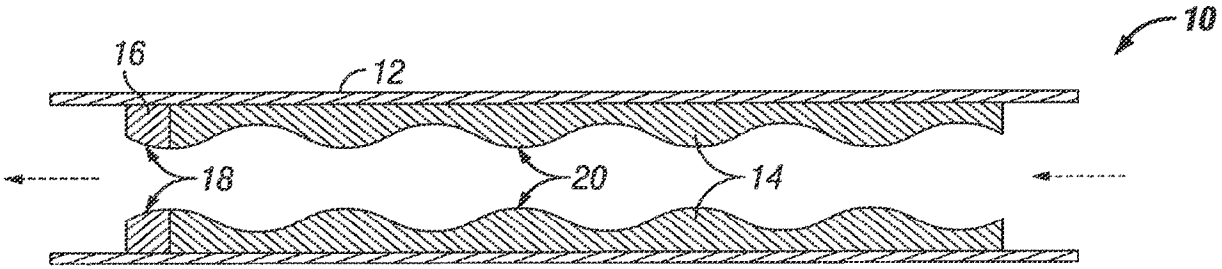
FIGS. 4-6 and 7A-7F are longitudinal sectional views of a stator having an insert within the stator section useful in a motor/pump assembly according to embodiments herein.

Referring now to FIG. 4, a stator according to embodiments disclosed herein is illustrated. Stator 10 may include a stator housing 12, which may have an inner surface with a profile that is circular (similar to FIG. 3), octagonal, hexagonal, oval, or helicoidal, among others. Stator 10 may also include a helicoidal section 14 disposed on or molded within housing 12. Helicoidal section 14 may be a solid rubber profile, as illustrated, or may include an even-wall profile. Helicoidal section 14, or a surface portion thereof, may be formed from a material having a first compressibility, such as a relatively soft rubber, and with typical rotor/stator interferences. Stator 10 may also include an insert 16 having a compressibility less than that of the helicoidal section 14. Insert 16 may be formed from a metal, ceramic, composite, or hard rubber, disposed at select points within the mud motor to constrain the movement of the rotor relative to the stator as discussed above. In some embodiments, inserts 16 may have low to zero interference with the rotor during operation of the motor or pump. It is also within the scope of the present disclosure that the insert(s) need not necessarily (but may, in some embodiments) refer to a separate, distinct component than the remaining portion(s) of the stator (or rotor) but may also be integrally formed with the remaining portion(s). For example, it is envisioned that a second section with less compressibility than a first section may be formed by selectively irradiating the second section to produce a higher crosslink density than the first section.

Figure 5:
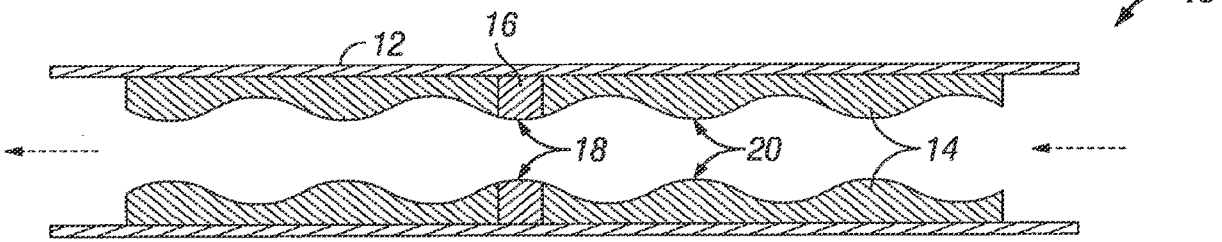
Figure 6:
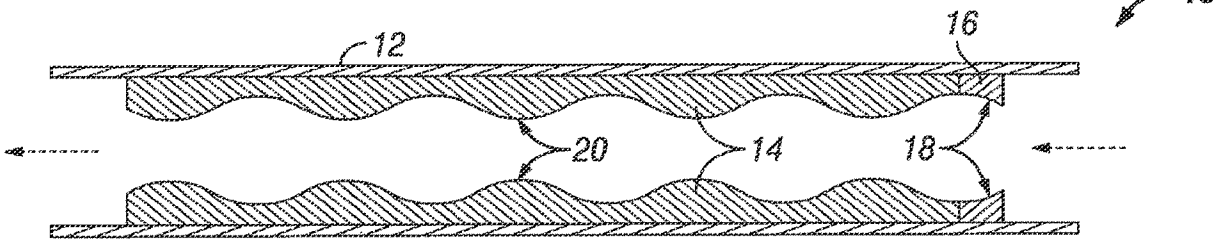
Figure 7A:
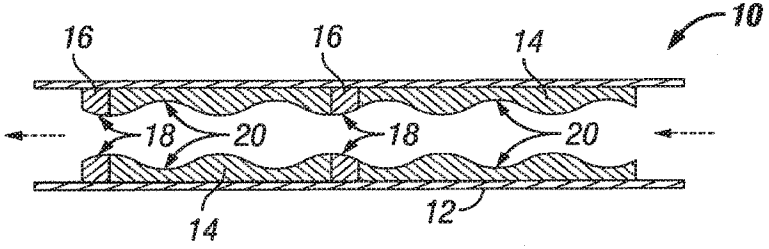
Figure 7B:
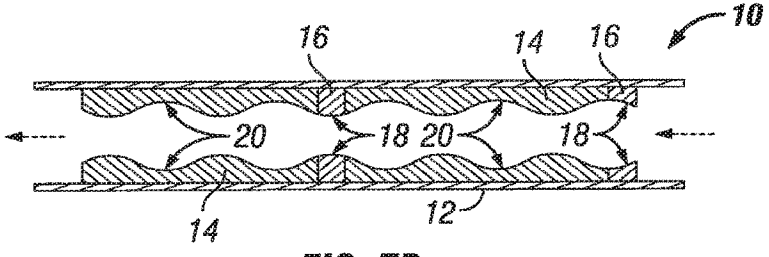
Figure 7C:
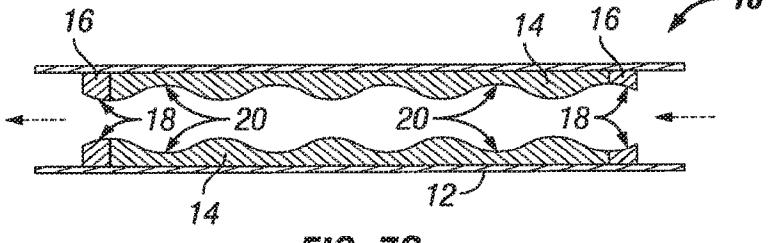
Figure 7D:
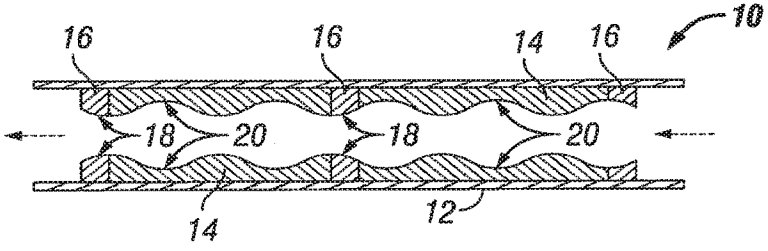
Figure 7E:
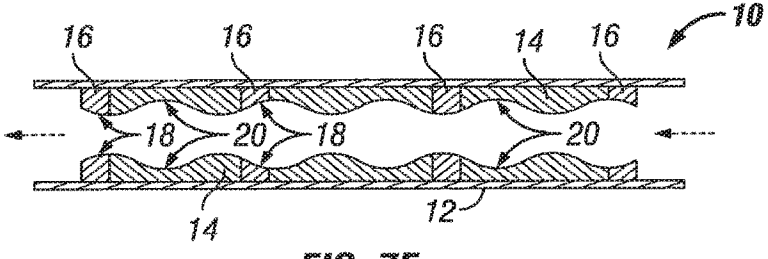
Figure 7F:
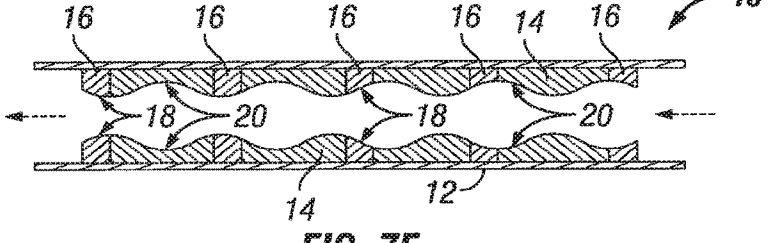

As illustrated in FIG. 4, insert 16 may be disposed proximate the outlet end of the stator. Alternatively, as illustrated in FIGS. 5 and 6, insert 16 may be disposed at an intermediate portion of the stator or at the inlet end of the stator. In other embodiments, such as illustrated in FIGS. 7A-7F, stators may include multiple inserts disposed proximate one or both of the inlet end and the outlet end as well as intermediate the inlet and outlet ends. Stators according to embodiments herein may include any number of inserts, the positioning of which may depend on the overall length of the stator, the external forces imposed on the stator (such as bending) and the rotor (such as radial loads due to centrifugal forces on the rotor and from the radial component of rotor thrust, as may be generated by an angled coupling to a transmission or drive shaft, as well as tangential loads, rotor bending, and others as may be appreciated by those skilled in the art). In some embodiments, such as illustrated in FIG. 7C, the stator may include a first insert disposed proximate the inlet end and a second insert disposed proximate the outlet end (as used herein, inlet and outlet refer to fluid flow, as illustrated; alternatively, proximal end and distal end may be used to describe the position of the insert with respect to a mud motor assembly disposed in a drill string, such as where the fluid inlet is proximal and the outlet is distal). Placement of the inserts in FIGS. 4-7 is not intended to limit the scope of the disclosure herein. The inserts may be placed at any advantageous position within the motor or pump.

Figure 9A:
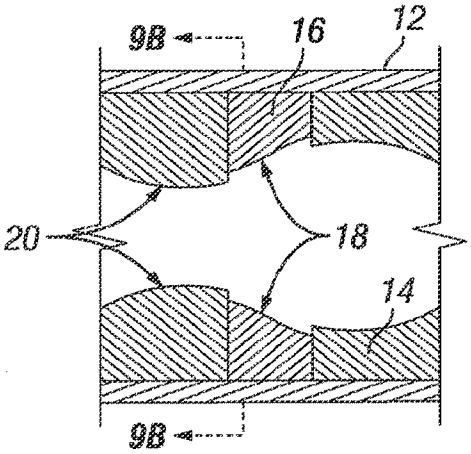
FIGS. 8A-8B and 9A-9B are longitudinal and axial sectional views of a stator having an insert within the stator according to embodiments herein.
Figure 9B:
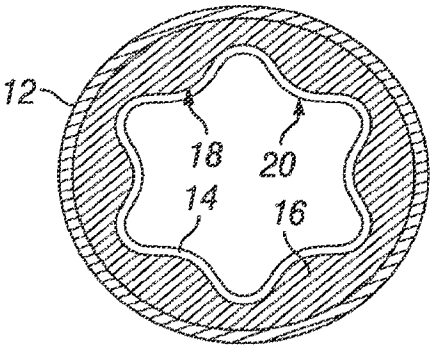
Figure 8A:
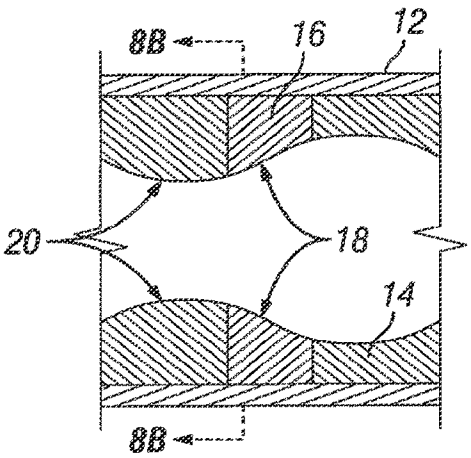
Figure 8B:
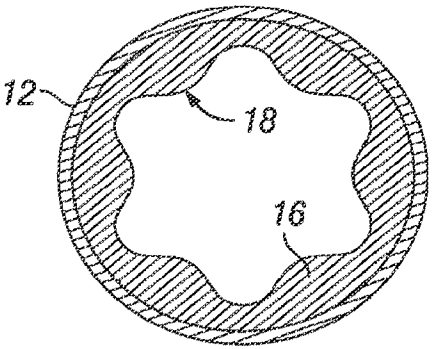

Each insert 16 may have an inner surface 18 that is similar in profile to that of the inner surface 20 of the helicoidal section 14. For example, insert 16 may have a shape of a ring that is similar to an imaginary rubber ring cut from the rubber tube with planes perpendicular to the stator axis; this shape is a general guideline and not intended to limit the shape of the insert. In some embodiments, the inner surface 20 of helicoidal section 14 and the inner surface 18 of insert 16 may form a continuous helical profile. For example, as illustrated in FIGS. 8A-8B and 9A-9B, the inner surface 18 of the insert 16 may form a portion of the helicoidal profile of helicoidal section 14. In some embodiments, the inner surfaces may form a continuous helicoidal profile, such as illustrated in FIGS. 8A and 8B. In other embodiments, such as illustrated in FIGS. 9A and 9B, the inner surface 18 of insert 16 may be of a reduced helicoidal profile; the reduce profile may allow limited compression of helicoidal section 14, for example. The lobes, profile, and characterizing diameters of the insert may be chosen to match the specific application. At least two things should be considered in determining the final insert profile: (1) allowing for rotor movement without seizure, and (2) not hindering the achievement of proper fit to obtain an optimum seal. In some embodiments, the insert(s) may limit a lateral movement of the rotor relative to the stator to a range of less than 100 microns. In other embodiments, the insert(s) may limit a lateral movement of the rotor relative to the stator to a range of less than 50 microns.

It would be appreciated by one of ordinary skill in the art that the length of the inserts is not necessarily as shown in FIGS. 4-7 but may be any desirable length based on the specific application. In some embodiments, inserts 16 may each have an axial length in the range from about 2 mm to about 50 mm. In other embodiments, inserts 16 may each have an axial length in the range from about 5 mm to about 25 mm. In comparison, the overall axial length of the stator may be in the range from about 1 foot (0.3 meters) to about 40 feet (10 meters), such as from about 1 meter or 1.5 meters (5 feet) to about 8 or 9 meters (about 30 feet).

In some embodiments, such as where the corresponding contacting portions of the rotor and insert(s) are both a metal, composite, or ceramic, for example, it may be desirable to limit the friction, wear, and other undesirable interactions between the rotor and stator that may cause premature failure or seizure of the rotating component. The contact surfaces of the insert and/or the rotor may be coated or treated to reduce at least one of friction and wear. Treatments may include chroming, HVOF or HVAF coating, and diffusing during sintering, among others. Further, the insert itself, or a surface portion thereof, may be formed from a hard, erosion and abrasion resistant material or combination of materials.

Figure 10:
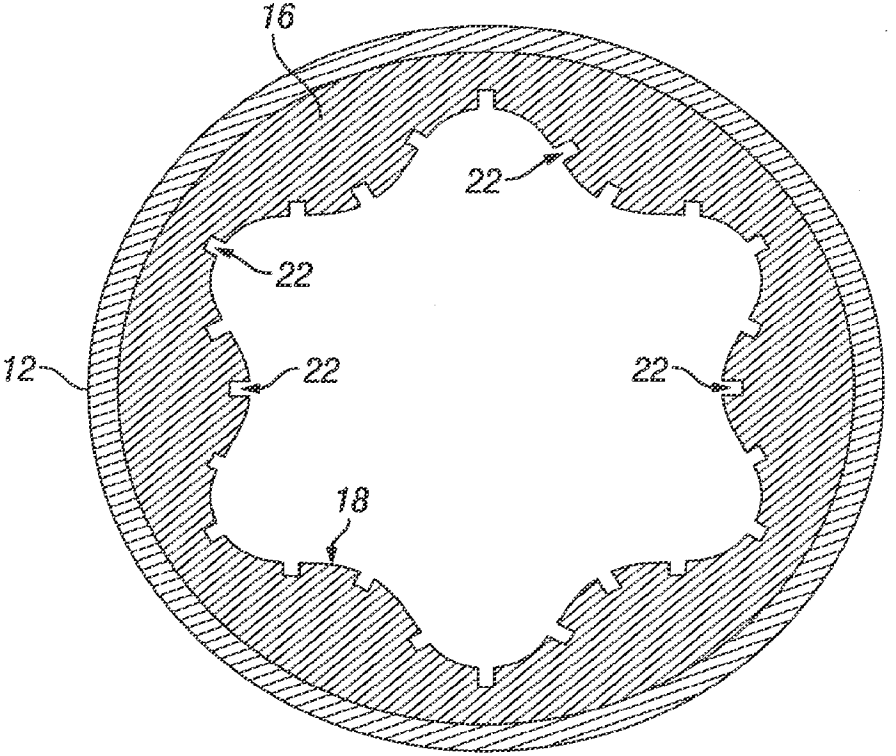
FIG. 10 is an axial sectional view of a stator insert having flow channels according to embodiments herein.

Drilling muds or other fluids processed through motors and pumps according to embodiments herein may contain solids or other materials. The limited overall axial length of the inserts may allow for flow of the solids through the assembly without issue. Alternatively, referring now to FIG. 10, inserts 16 may include one or more flow channels 22 (e.g., grooves), allowing for the passage of fluids, with or without solids, through the insert. In this or similar manners, the topography of the contact surfaces may be elaborated to minimize friction and wear while preventing jamming during operations due to the solids present in the fluids.

Figure 11:
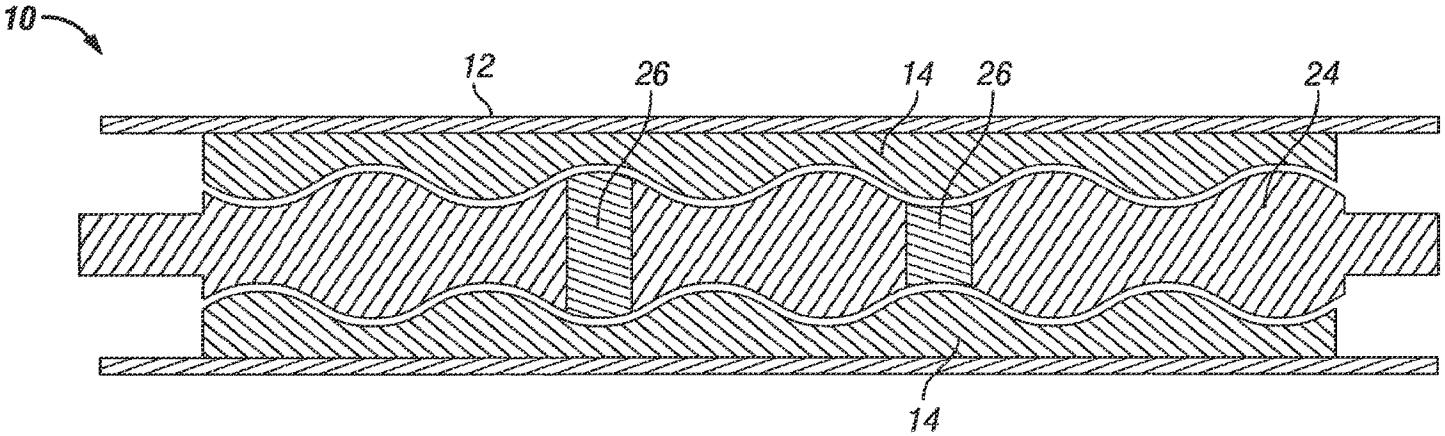
FIGS. 11 and 12 are axial sectional views of a pump or motor assembly including a rotor having an insert according to embodiments herein.
Figure 12:
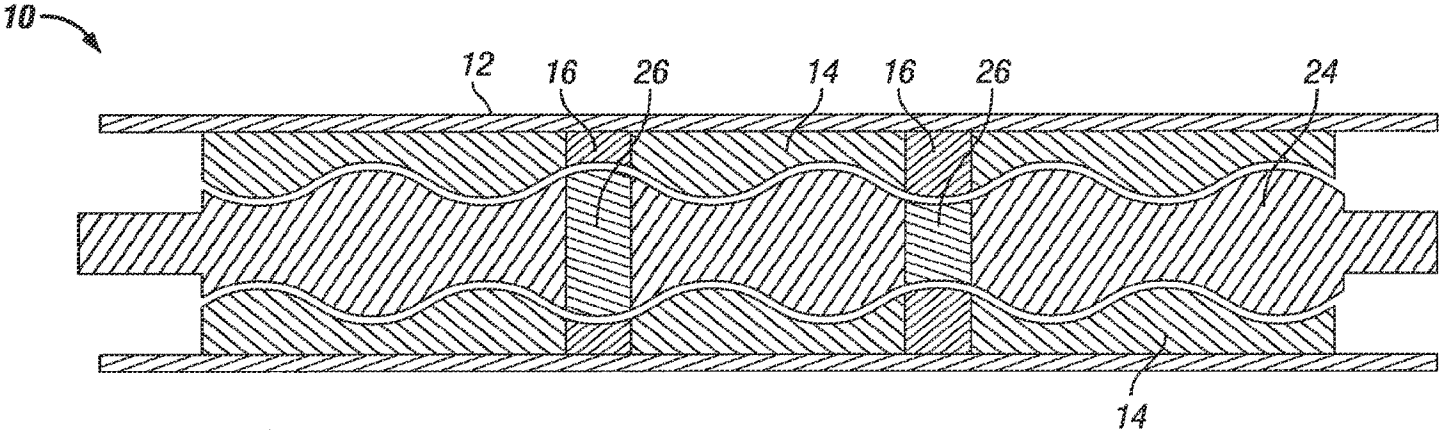
Figure 21:
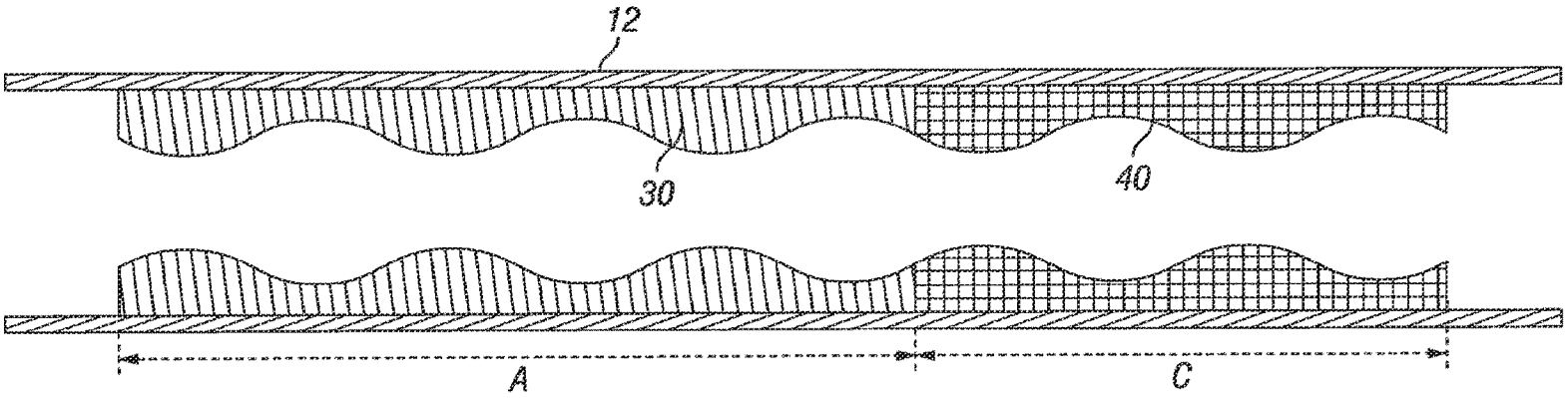

It is also contemplated to constrain the lateral movement of the rotor within the stator by placing inserts on the rotor. Referring now to FIG. 11, a motor or pump assembly according to embodiments disclosed herein may include a rotor having a first helicoidal section 24 and one or more inserts 26 disposed along the length of the rotor. In other embodiments, such as illustrated in FIG. 12, the stator may include a first helicoidal section 14 and an insert 26 disposed proximate stator inserts 16. Inserts 16 and 26 may be formed from the same or different metal, composite, or ceramic. Additionally, rotor inserts 26 may include flow channels (not illustrated) or other topography to provide for solids flow, similar to that discussed above with respect to stator flow channels 22. While the inserts in FIG. 12 are illustrated as matching the helicoidal profile of the rotor and stator, it is also contemplated that the matching pair of inserts may be any shape or combination of shapes where the profiles of the matched pair, when assembled on the shaft and sheath respectively, limit the lateral movement of the shaft in the sheath. In some embodiments, such as illustrated in FIG. 21, the profile of the inserts may be similar, if not identical, to the profile of the rubberized or metal (or equivalent metal) shaft or sheath to which they are attached.

As noted above, there may be little or no interference contact between the respective portions of the rotor and stator. The limited interference between the respective portions of the rotor and stator may limit the compression of the helicoidal section 14. For example, as noted above, inserts 16 may have a reduced profile providing for limited compression of the rubber helicoidal section. Additionally, rotor motion may result in bending or other movements that may also be limited by inserts. During operation, compression of the rubber in helicoidal section 14 may be less than about 100 microns; less than about 75 microns in other embodiments; less than about 50 microns in other embodiments; and less than about 25 microns in yet other embodiments.

Any acceptable manufacturing or fixing mechanism may be used to fix, dispose, or otherwise locate the insert in place to handle the downhole stresses and to provide proper seal to avoid mud induced wash out. The inserts may be machined with high speed milling, grinding, ECM, EDM, sintered net or near shape, cast, printed, injected, molded, or generated by a combination of these and other manufacturing methods. The inserts may be an integral part of the shaft or the sheath, or may be installed onto the shaft or the sheath by one or more of the following methods: press-fit, welding, brazing, threading, fusing, gluing, or various mechanical or pressure locking devices. Inserts according to embodiments disclosed herein may provide benefits to Moineau machines, and may be used with currently known manufacturing techniques, including conventional technology with a metallic shaft and a rubberized cylindrical sheath, and thin wall technology, where one or both of the shaft and sheath are rubberized by any method where the profiled shaft and/or sheath is made my any technique, such as cold forming, hot forming, casting, milling, grinding, broaching, ECM, EDM, injecting, molding, and metal-to-metal technology.

Further, inserts according to embodiments herein may be added as a modification on already existing stators. As an example, inserts may be disposed at the extremities (proximal end, distal end) after the stator and rotor have been manufactured, and may also be replaced as needed.

As described above, inserts used in embodiments of motors and pumps disclosed herein may support lateral forces between the metallic rotor and the stator, and ease the stress on the rubber portions of the motor or pump. Another potential advantage of these inserts, disposed on the rotor, the stator, or both, may be to limit lateral vibrations of the rotor against the stator, which may induce rapid deterioration of rubber once it starts. It is also possible by proper centralization of the rotor inside the stator that these inserts may help produce an even loading profile along the length of the stator and thus improve reliability and allow greater loading to be applied to the power section.

Another potential benefit as disclosed herein may be the increase in efficiency of the motors or pumps, such that, for example, a shorter motor may produce equivalent power of a traditional longer motor. There may be many potential advantages to a shorter motor. For example, shorter motors may be easier to manufacture and manufacturing of a shorter motor may lend itself to the use of advantageous manufacturing techniques that are not feasible in the manufacture of shorter motors. Further, decreasing the overall length of motors according to embodiments herein may provide advantages during the drilling process.

As noted above, the first, compressible section and the second, relatively incompressible section may be formed as distinct sections of the stator assembly, thus providing for both the desired structural and power generating functions. Embodiments of positive displacement motors and pumps according to embodiments disclosed herein may include a rotor and a stator, where the stator includes a first "power generating section," where the stator is formed from a solid rubber of varying thickness, and a "gearing section," where the stator is a structural member, for example a metal, composite, hard plastic, ceramic, or stiff rubber structural member, or alternatively an "even wall" stator. In other embodiments, the "power generating section" may be an "even wall" stator and the "gearing section" may be formed from a metal, composite, or ceramic; in general, the compressibility of the power generating section is less than the compressibility of the gearing section, similar to the inserts described with respect to FIGS. 4-12. In these manners, the sealing and structural functions of the stator are separated, allowing the materials of each section to be optimized independently. In the power-generating section, for example, the stator materials can be optimized for sealing. In the gearing section, the stator materials can be optimized for handling mechanical loads.

For example, an all-rubber stator does well sealing at low pressure and torque, but typically suffers from the heat generated by hysteresis due to deflection from interference, as well as from wear and tear from the mechanical loads (from centrifugal force and torque-reaction) imposed upon it. Further, the mechanical loads make the lobes deflect enough to create leakage between individual chambers, reducing efficiency. Conventional (relatively soft) rubber has good abrasion resistance, but poor structural properties. Hard rubber (HR) does a better job of handling mechanical loads, but is more prone to wear rapidly due to lower elastomer content. On the other hand, an all-even wall stator does well structurally, handling centrifugal and torque-reaction loads, but typically must be designed to run at lower rotor-stator interference, and thus loses power and efficiency more rapidly as the rubber wears. Motors and pumps according to embodiments herein may thus synergistically utilize the molded power generating section and the even wall gearing section to improve motor/pump performance.

Figure 13:
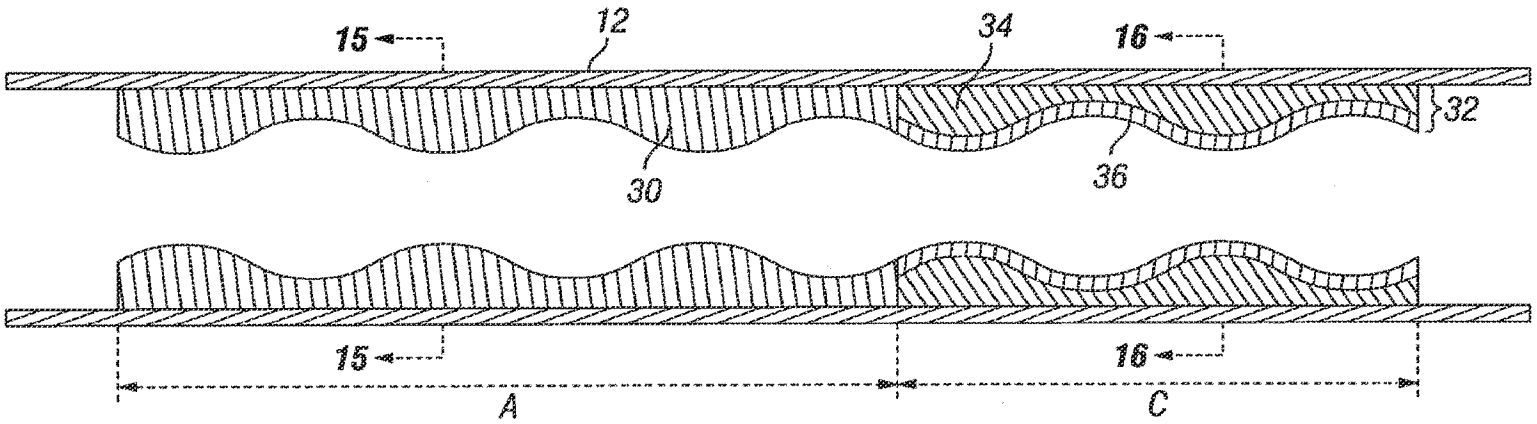
FIGS. 13 and 14 are a simplified schematic diagram of a motor/pump power generating assembly according to embodiments disclosed herein having a power generating section A and a gearing section C.
Figure 14:
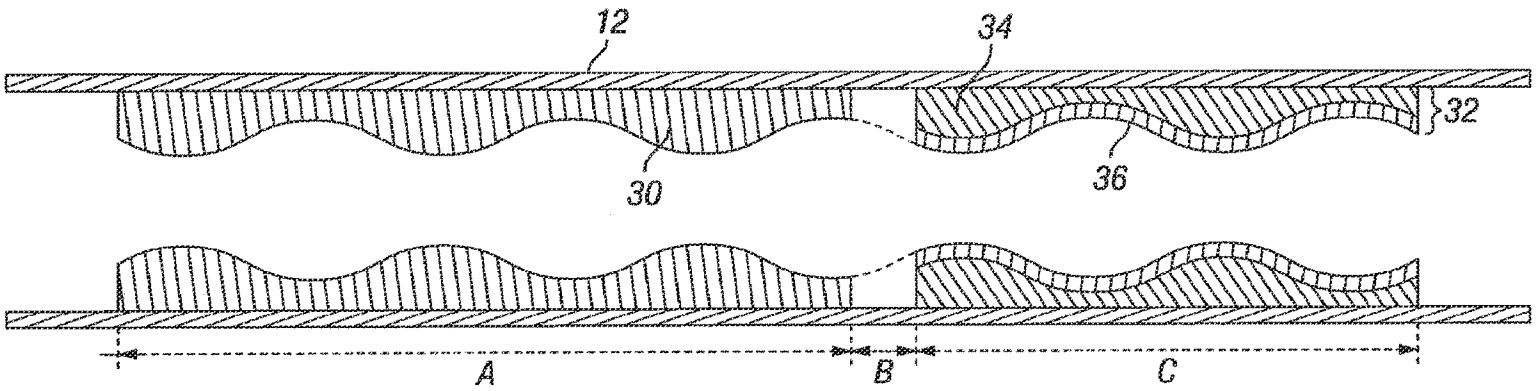

Referring now to FIGS. 13 and 14, a stator of a power section of a motor or pump according to embodiments herein are illustrated, where like numerals represent like parts. The stator 10 may include a housing 12 including a power generating section A (such as the first section, as described above) and a gearing section C (such as the second section, as described above).

In some embodiments, such as illustrated in FIG. 14 (as well as FIGS 17-20), the power generating section A and the gearing section C may be separated by a hydraulic disconnect section B. This "interrupted" section with no rubber profile would thus not form any sealed chambers, hydraulically disconnecting the power generating section from the gearing section.

When separated by a hydraulic disconnect section B, the helical profile of the power generating section A may be the same or different than the helical profile of gearing section C. When different, the rotor should be configured to run properly in the respective sections, and may be formed as a continuous shaft or may include two sections coupled together, such as within the hydraulic disconnect section B. When it is desired to use a rotor of a continuous profile, the power generating section A and the gearing section C may form respective portions of a continuous helical profile (i.e., accounting for the hydraulic disconnect section B). In such an instance, the gearing section and power sections may have a similar profile, and should be aligned so that the rotor profile and helix are unchanged. In other embodiments, the power generating section A and the gearing section C may form a continuous helical profile, such as illustrated in FIG. 13.

Figure 15:
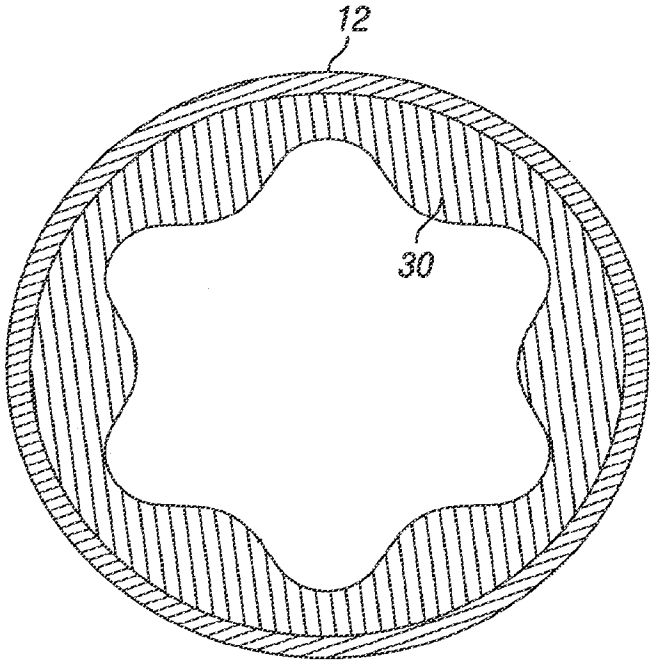
FIG. 15 is a cross-sectional view of a power generating section A or a gearing section C having an all-rubber profile.

The power generating section may be a solid rubber profile 30, having a non-uniform thickness and a helical profile, disposed in or molded within a housing 12, such as illustrated in FIG. 15. Solid rubber portion 30 may be a relatively soft rubber with typical rotor/stator interferences.

Figure 16:
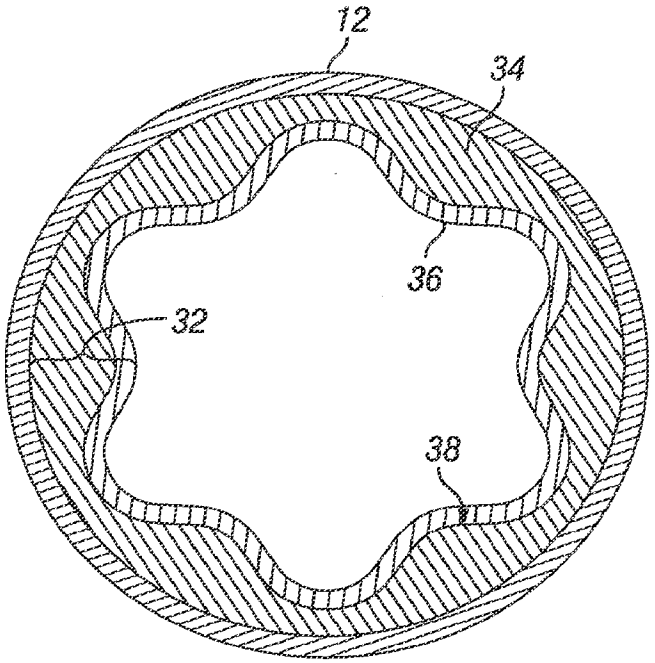
FIG. 16 is a cross-sectional view of a gearing section C having an even-wall rubber profile.

In some embodiments, the gearing section may be an even wall rubber profile 32, including a metallic, ceramic, or composite profile section 34 and a rubber layer 36 having a relatively uniform thickness disposed in a housing 12, such as illustrated in FIG. 16. Housing 12 may be cylindrical (circular profile), octagonal, hexagonal, oval, helicoidal, or of virtually any profile. Housing 12 may be integral or non-integral with a profile section 34 that has an inner surface 38 having a helical profile, a non-helical profile, or combinations thereof. The even wall rubber profile 36, also having a helical profile, may be formed by disposing a relatively thin layer of rubber having a substantially uniform thickness on inner surface 38. As readily understood by one skilled in the art, "even wall" profiles may vary in thickness to a degree based on manufacturing tolerances and imperfections, or even designed-in relatively minor thickness variations on the order of up to 3 percent of the stator tube outer diameter, and yet be considered to have a substantially uniform thickness. Profile section 34 may have a helical inner surface profile that is sharp, primitive, improved, or other types of profiles as known to those skilled in the art.

Figure 17:
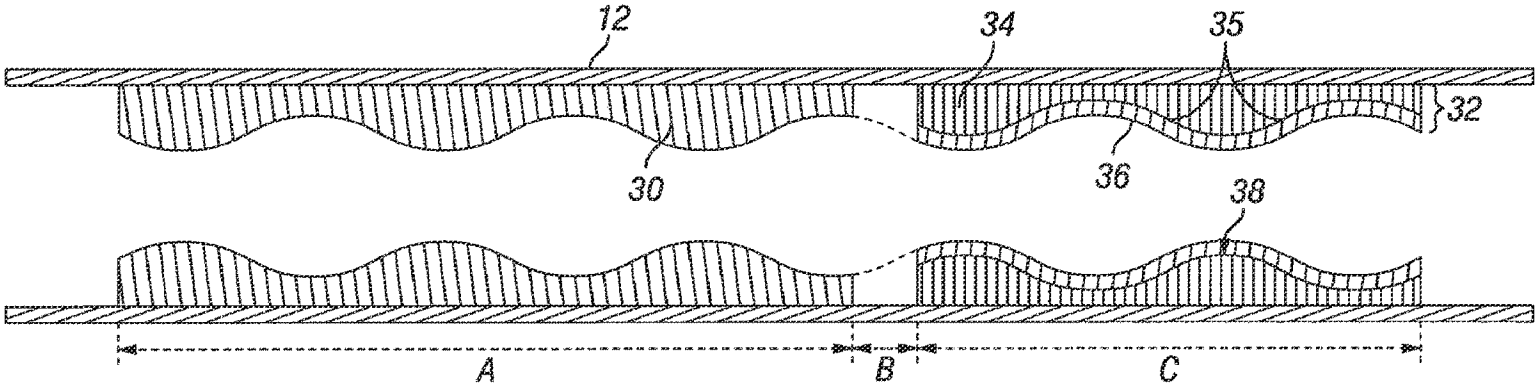
FIGS. 17-22 illustrate motor/pump assemblies according to embodiments disclosed herein with various gearing sections C.

One example of a non-integral profile section is illustrated in FIG. 17, where like numerals represent like parts. Profile section 34 may include stacked wafers 35 arranged in housing 12 to create an inner surface 38 having a helical profile, the even wall rubber profile 36 being formed by disposing a relatively thin layer of rubber having a substantially uniform thickness on the inner surface 38. The stacked wafers 35 may be affixed to housing 12 using attachment means including epoxy, interference fit, or other attachment means known to those skilled in the art.

Figure 18:
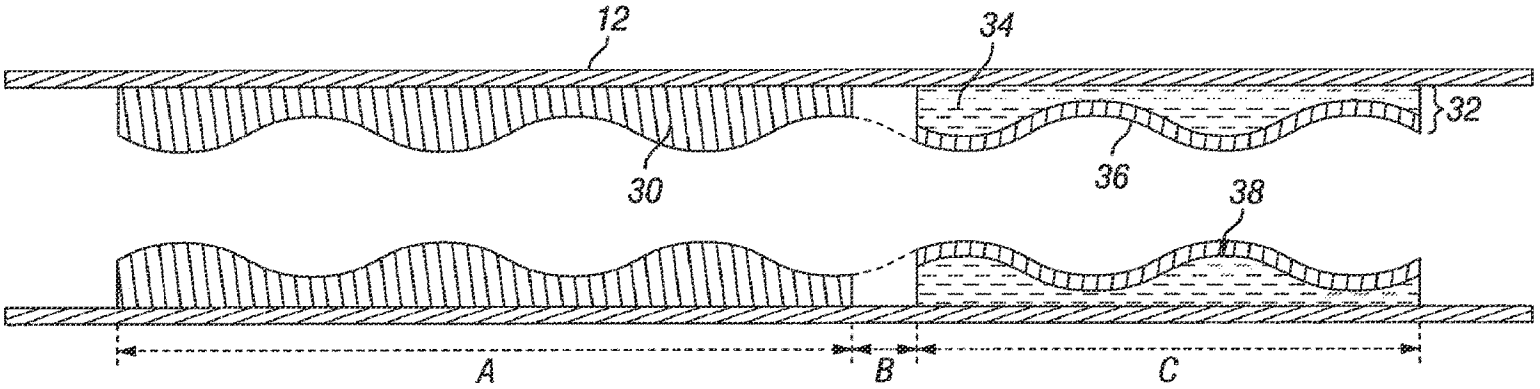

FIG. 18 illustrates another example of a non-integral profile section, where like numerals represent like parts. Profile section 34 may be a molded, cast, or machined insert that has an inner surface 38 having a helical profile disposed in housing 12. The even wall rubber profile 36 is formed by disposing a relatively thin layer of rubber having a substantially uniform thickness on inner surface 38, prior to or following disposition of the insert within housing 12, such as via means including threading, interference fit, or affixing the insert via use of an epoxy, for example.

Figure 19:
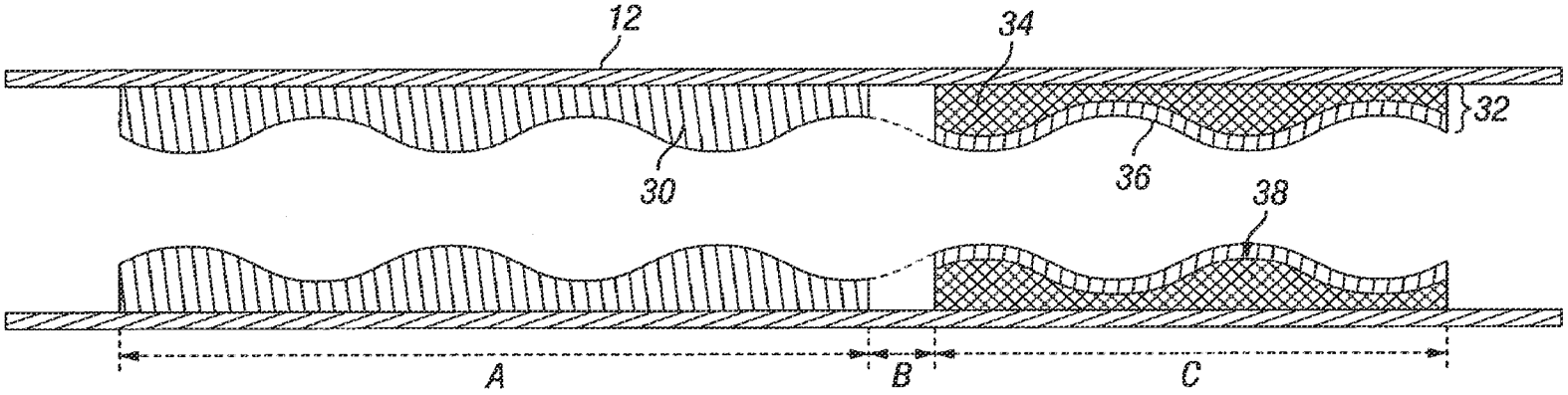

FIG. 19 illustrates another example of a non-integral profile section, where like numerals represent like parts. Profile section 34 may be an epoxy composite comprising an inner surface 38 having a helical profile, the epoxy composite being molded, cast, or bonded into housing 12. The even wall rubber profile 36 is formed by disposing a relatively thin layer of rubber having a substantially uniform thickness on inner surface 38.

Figure 20:
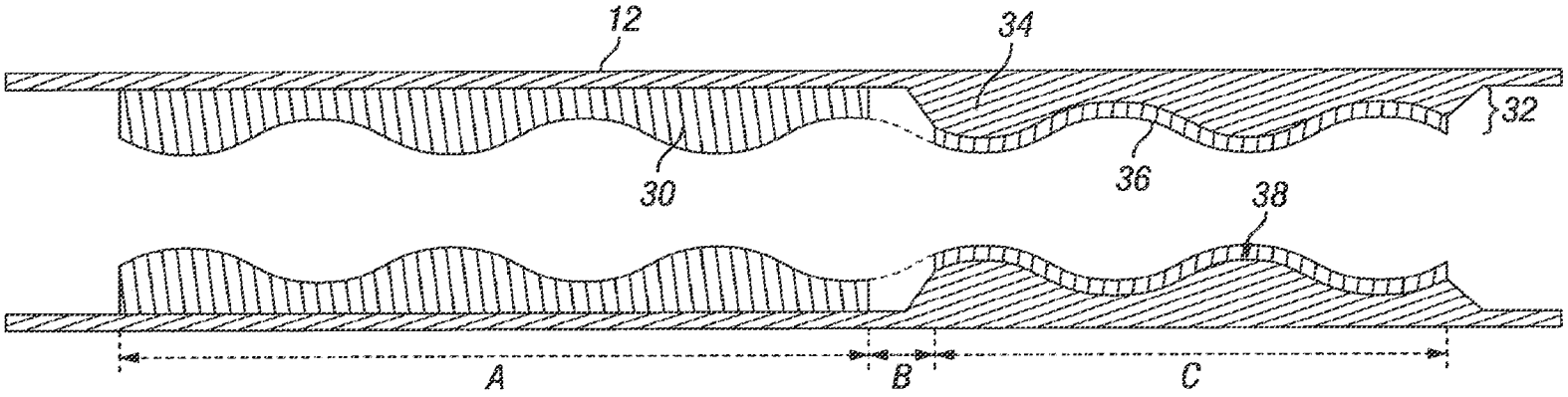

FIG. 20 illustrates an example of an integral profile section, where like numerals represent like parts. Profile section 34 may be an integral machined or cast section of a housing 12, the integral section comprising an inner surface 38 having a helical profile. The even wall rubber profile 36 is formed by disposing a relatively thin layer of rubber having a substantially uniform thickness on inner surface 38.

The gearing section may comprises a first rubber and the power section may comprises a second rubber, where the first rubber and the second rubber may be the same or different. In some embodiments, the first rubber (gearing section) is harder (i.e., stiffer, less compressible) than the second rubber (power generating section). As noted above, the power generating section may be formed using a relatively conventional rubber with typical interferences. For example, the conventional rubber widely used in mud motors may be on the order of 65 to 85 durometer on the Shore A hardness scale, with interference on the order of 0.005 inch to 0.040 inch, as conventionally measured on the diameter at room temperature, and as configured for typical drilling conditions. In contrast, the gearing section may comprise a hard rubber with low interference to a clearance. In this context, "hard" rubber may be on the order of 80 to 100 durometer on the Shore A hardness scale, "low" interference may be on the order of zero to 0.010 inch, and "clearance" may be on the order of zero to 0.025 inch. It should be noted that these values are taken at room temperature, and compensation is normally made for thermal expansion of rubber at downhole temperature. So, for example, a clearance of 0.025 inch at room temperature may be chosen to create zero interference at a high down hole temperature, for example 350 degrees Fahrenheit. Interference guidelines may be found from a variety of power section manufacturers, such as Dyna-Drill Technologies, Inc., available at dyna-drill.com. One skilled in the art would readily understand that "soft" and "hard" refer to the relative elasticity or compressibility (flexibility, brittleness, etc.) of the elastomeric (rubber) material used to form the inner contact surface of the stator, a harder rubber being less compressible than a softer rubber, for example. Elastomers that may be used in embodiments herein include, but are not limited to, compounds known in the industry as NBR, HNBR, and HSN. Further, it should be noted that as anticipated drilling environmental conditions, including the type of drilling mud and bottom hole temperature, are typically a factor in rubber selection criteria, the exact hardness values of the rubbers chosen are not as important as the difference between the two. For example, in a typical embodiment, the hardness of the rubber in the power generating section may be on the order of 10 to 25 Shore A hardness points softer than the hardness of the rubber in the structural gearing section. For example, the rubber in the power generating section may be a NBR rubber with 70 Shore A hardness and the rubber in the gearing section may be a NBR rubber with 85 Shore A hardness, where each may have deflection properties as follows.

| NBR Rubber with 70 Shore A Hardness | NBR Rubber with 85 Shore A Hardness |
|---|---|
| Modulus at 25% elongation = 170 psi | Modulus at 25% elongation = 500 psi |
| Modulus at 50% elongation = 240 psi | Modulus at 50% elongation = 700 psi |
| Modulus at 100% elongation = 390 psi | Modulus at 100% elongation = 1100 psi |
| Modulus at 200% elongation = 900 psi | Modulus at 200% elongation = 2100 psi |
| Compression Modulus @ 5% = 55 psi | Compression modulus @ 5% = 160 psi |
| Compression Modulus @ 10% = 115 psi | Compression modulus @10% = 360 psi |
| Compression Modulus @ 15% = 175 psi | Compression modulus @15% = 580 psi |

The gearing section C may be axially and helically aligned with power generating section A. As one skilled in the art may readily appreciate, due to the complexity of the stator manufacturing process, concentricity of the resulting stator with the stator cylinder (housing) itself cannot be guaranteed. As such, steps should be taken during the process to manufacture the stator to ensure alignment between the various sections (gearing and power generating).

The ratio of the length of the power generating section to the length of the gearing section may be in the range from about 1:1 to about 400:1 in some embodiments; in the range from about 2:1 to about 30:1 in other embodiments; in the range from about 3:1 to about 20:1 in other embodiments; and in the range from about 2:1 to about 10:1 in yet other embodiments. For example, mud motors according to embodiments herein may have an overall length in the range from about 5 feet to about 30 feet, where in some embodiments the gearing section may have a length in the range from about 0.5 feet to about 5 feet, and in other embodiments in the range from about 1 foot to 3 feet.

In other embodiments, such as illustrated in FIG. 21, the power generating section A and the gearing section C may both be formed as a solid rubber profile (30, 40, respectively), having a non-uniform thickness and a helical profile, disposed in or molded within a housing 12. Gearing section C may be formed using a solid rubber profile, similar to that as illustrated in FIG. 15. In this embodiment, gearing section C is formed using a rubber that is harder than that of the power generating section A. Similar to other embodiments, hard rubber gearing section C and soft rubber power generating section A should form respective sections of a continuous helical profile.

Figure 22:
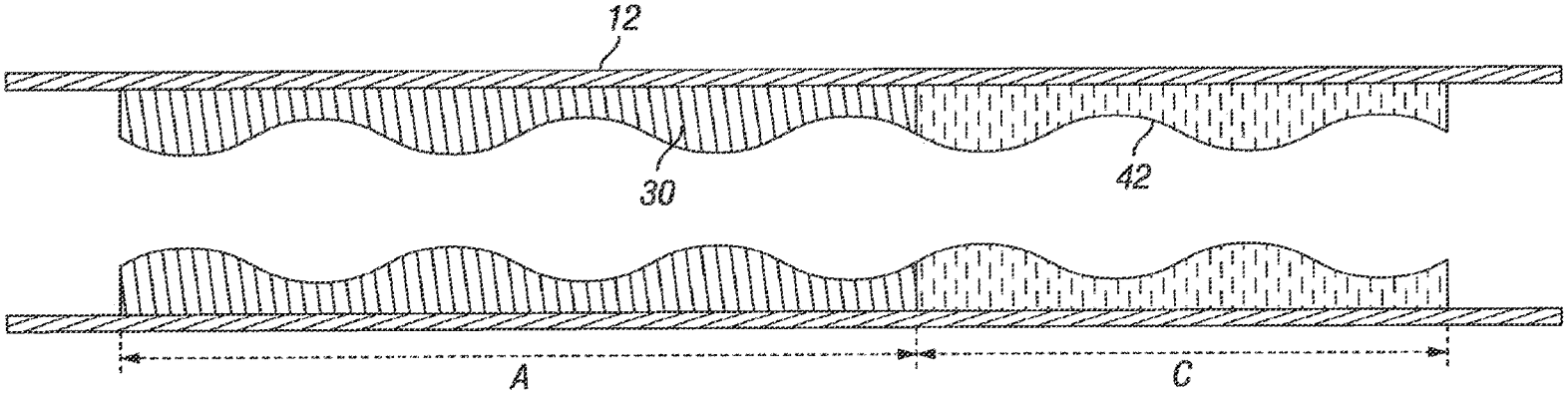

As illustrated in FIG. 22, gearing section C may be formed using a metal 42, a composite, a ceramic, or other various materials that may provide the desired structural function. In some embodiments, the material may be coated with a material having a low coefficient of friction or a hard, erosion and abrasion resistant material.

Motor assemblies as described above separate the power section of the progressive cavity motor (or pump) into two sections, one of which is purpose-built to seal and generate power, while the other of which is purpose-built to handle the structural loads generated by the first. The function of the gearing section, such as in mud motors according to embodiments herein, for example, is to handle (1) the radial loads generated from centrifugal force of the rotor and from the radial component of rotor thrust, as reacted by the angled CV-Joint (coupling to the transmission or drive shaft), and (2) the tangential loads normally acting on the stator lobes, acting as a gear. Separating these functions allows the materials in each section to be optimized independently.

In some embodiments, the gearing section is located proximate the end of the rotor that is coupled to the transmission or drive shaft (i.e., the motor output end or the pump drive end). Forces proximate the drive shaft, for example, may be different than those at the opposite end of the rotor due to torque generation (input), pressure differentials, and other factors as noted above. Placement of a gearing section proximate the end of the rotor that is coupled to the transmission or drive shaft may thus advantageously handle the radial and tangential loads, minimizing the formation of flow gaps in the power generating section.

While the drive shaft may be attached to either end of a rotor, in some embodiments, the gearing section is located proximate the distal end of the rotor. As used herein, the distal end refers to the portion of the rotor that is coupled to the transmission or drive shaft (i.e., the motor output end or the pump drive end), and the proximal end of the rotor refers to the portion of the rotor not coupled to the transmission or drive shaft (i.e., the drive (drilling) fluid input end or the pump output end). Forces at the distal end of the rotor may be different than those at the proximal end of the rotor due to torque generation (input), pressure differentials, and other factors as noted above. Placement of a gearing section proximate the distal end may thus advantageously handle the radial and tangential loads, minimizing the formation of flow gaps in the power generating section.

In other embodiments, a gearing section is located proximate the proximal end of the rotor. Gearing section(s) may also be located intermediate the proximal and distal end of the rotor. For example, gearing sections disposed proximate the middle of the stator may be used to control rotor bending and motion as a predictable function of stator bending. With respect to rotor motion in the gearing section, in some embodiments the rotor pitch diameter may roll along the stator pitch diameter without slippage about the pitch diameters. Further, as a result of the gearing section(s), the rotor's longitudinal axis may remain parallel to the stator axis, eliminating rotor wobbling or tilting.

In yet other embodiments, motor assemblies according to embodiments disclosed herein may include a first gearing section located proximate the distal end of the rotor, a second gearing section located proximate the proximal end of the rotor, and a power generating section intermediate the first and second gearing sections. Such an arrangement may be advantageous where the forces acting on the proximal end of the rotor also contribute to the formation of flow gaps in the power generating section.

Embodiments disclosed herein also relate to a method of manufacturing an outer member of a moving or progressive cavity motor or pump, such as a stator. The method may include: disposing a layer of a first rubber having a substantially uniform thickness and a helical profile on an inner surface of a first section of the outer member; and disposing a second rubber having a non-uniform thickness and a helical profile on an inner surface of a second section of the outer member (i.e., the stator cylinder or housing).

The method may also include forming the outer member to have a first section comprising an inner surface having a helical profile. For example, forming the housing may include at least one of: stacking wafers in a housing to create an inner surface having a helical profile; molding, casting, or machining an insert comprising an inner surface having a helical profile and disposing the insert in a cylindrical housing; molding or casting an epoxy composite comprising an inner surface having a helical profile in a housing; machining or casting a housing comprising an integral section comprising an inner surface having a helical profile.

During the disposing steps, it may be desirable to form the power generating section and the gearing section as a continuous helical profile or a discontinuous helical profile. In embodiments forming a discontinuous helical profile, the method may also include spacing the layer of first rubber from the layer of second rubber to form a third section hydraulically disconnecting the first and the second sections. Additionally, the disposing steps may be performed via a continuous rubber injection process or may be performed during discrete rubber placement processes, such as spray coating of an even wall gearing section and injection molding of the solid rubber power generating section. The method may also include adjusting a location of the housing to align the helical profile of the first rubber layer with the helical profile of the second rubber layer.

The above described mud motor assemblies, including a stator having a power generating section and a gearing section, may be used in a drilling assembly for drilling a wellbore through a subterranean formation. The drilling assembly may include, for example, a mud motor assembly as described in any of the above embodiments, and including, among other components: a top sub, a power section including a progressive cavity motor having a stator and a rotor configured to rotate eccentrically when a drilling fluid is passed through the motor, a rotor catch device, and a device for constraining the motion of the rotor catch device. The drilling assembly may also include a motor output shaft configured to rotate concentrically, a first end of which is directly or indirectly coupled to the rotor, and a second end of which is coupled, indirectly or directly, to a drill bit.

In operation, a drilling fluid is passed through the mud motor assembly, eccentrically rotating the rotor as the drilling fluid passes through the progressive cavity motor. The motor output shaft transmits the eccentric rotor motion (and torque) to the concentrically rotating drill bit to drill the formation. The device for constraining the motion of the rotor or the rotor catch device imparts corrective forces to the rotor, constraining the movement of the rotor relative to the stator, improving the overall performance of the mud motor and the drilling assembly as a whole by counteracting the centrifugal forces and hydraulic pressure loading on the rotor, limiting, minimizing, or eliminating the formation of flow gaps along the length of the motor.

As the gearing section and power generating section are specifically designed to handle the different forces encountered along the length of the power generating section of the motor, improved sealing between the stator/rotor pair may result in the power generating section. A corresponding improvement in one or more of rotary speed output per gallon, developed torque, pressure drop, design centrifugal and torque loads, wear characteristics, as well as other motor properties as compared to a traditionally designed stators (all even wall or all rubber) of similar size and configuration (i.e., lobe count, diameter, materials of construction, length, helix angle, etc.) may be realized. The resulting increase in torque and/or rotary speed may, for example, allow for a greater force to be applied to the drill bit or for the drill bit to be rotated at a greater rotary speed, both of which may individually or collectively result in improved drilling performance (less time to drill a given depth, etc.). Alternatively, the resulting increase in torque and/or rotary speed may allow for a reduction in the length of the motor (rotor/stator pair length) to achieve the same desired performance. Further, as motor assemblies according to embodiments disclosed herein use a relatively short even wall section, the structural benefits of even wall stators may be realized at a significantly reduced cost (i.e., not having to machine the even-wall profile over the entire length of the stator tube).

Stators and rotors having inserts and/or gearing sections as described above may be described by one or more of the following embodiments:

1. A mud motor comprising a rotor and a stator, the stator having one or more inserts or gearing sections to limit a lateral movement of the rotor relative to the stator.
2. A moving or progressive cavity motor or pump, comprising:
   a rotor;
   a stator comprising:
      a first, helicoidal section comprising a compliant material having a first compressibility;
      a second section, helicoidal, non-helicoidal, or combination thereof, having a second compressibility, wherein the second compressibility is less than the first compressibility.
3. The motor or pump of embodiment 2, wherein the first section comprises a first rubber and the second section comprises a second rubber.
4. The motor or pump of embodiment 2, wherein the first section comprises a rubber and the second section comprises at least one of a metal, a composite, and a ceramic.
5. The motor or pump of embodiment 3 or embodiment 4, wherein the second section has low to zero interference with the rotor during operation of the motor or pump.
6. The motor or pump of any one of embodiments 2-5, wherein the first section and second section form a continuous helical profile.
7. The motor or pump of embodiment 6, wherein an inner surface of the second section has the same profile as an inner surface of the first section.
8. The motor or pump of embodiment 6, wherein an inner surface of the second section has a reduced profile with respect to an inner surface of the first section.
9. The motor or pump of any one of embodiments 2-8, wherein the stator comprises a second section proximate a distal end of the stator and a second section proximate the proximal end of the stator.
10. The motor or pump of any one of embodiments 2-9, further comprising a second section intermediate a distal end and a proximal end of the stator.
11. The motor or pump of any one of embodiments 2-10, wherein the second section(s) has(have) an axial length in the range from about 2 mm to about 1525 mm.
12. The motor or pump of any one of embodiments 2-10, wherein the second section(s) has(have) an axial length in the range from about 5 mm to about 25 mm.
13. The motor or pump of any one of embodiments 2-10, wherein the second section(s) has(have) an axial length in the range from about 305 mm (1 foot) to about 1525 mm (5 feet).
14. The motor or pump of any one of embodiments 2-13, wherein the stator has an overall axial length in the range from about 1 foot to about 40 feet.
15. The motor or pump of any one of embodiments 2-14, wherein a contact surface or portion thereof of at least one of the second section and the rotor is coated or treated to reduce at least one of friction and wear.
16. The motor or pump of any one of embodiments 2-15, wherein the second section of the stator includes one or more flow channels.
17. The motor or pump of any one of embodiments 2-16 wherein the rotor comprises:
   a first helicoidal rotor section; and
   a second rotor section, helicoidal, non-helicoidal, or combination thereof, disposed proximate the stator second section.
18. The motor or pump of embodiment 17 wherein the second rotor section and the second section of the stator each comprise the same metal, composite, or ceramic.
19. The motor or pump of any one of embodiments 17-18, wherein the second rotor section includes one or more flow channels.
20. The motor or pump of any one of embodiments 2-19, wherein, during operation, compression of the first stator section is less than 50 microns.
21. The motor or pump of any one of embodiments 2-20, wherein the second section(s) comprise a metal insert disposed proximate at least one of the proximal end and the distal end of the stator.
22. The motor or pump of any one of embodiments 2-20, wherein the second section(s) comprise a gearing section disposed proximate at least one of the proximal end and the distal end of the stator.
23. A method of drilling a wellbore through a subterranean formation, the method comprising:
   passing a drilling fluid through a mud motor assembly, the mud motor assembly comprising a moving or progressive cavity motor having a proximal end and a distal end, the motor comprising:
      a rotor; and
      a stator comprising:
         a power generating section; and
         a gearing section;
         the gearing section reacting the loads generated by the power generating section; and
   drilling the formation using a drill bit directly or indirectly coupled to the rotor.
24. A mud motor assembly comprising a moving or progressive cavity motor having a proximal end and a distal end, the motor comprising:
   a rotor; and
   a stator comprising:
      a power generating section; and
      a gearing section;
      the gearing section reacting the loads generated by the power generating section.

25. A drilling assembly comprising:
a mud motor assembly comprising a moving or progressive cavity motor having a proximal end and a distal end, comprising:
a rotor; and
a stator comprising:
a power generating section; and
a gearing section;
the gearing section reacting the loads generated by the power generating section;
a motor output shaft directly or indirectly coupled to the rotor; and
a drill bit directly or indirectly couple to the motor output shaft.

26. A moving or progressive cavity motor or pump assembly having an inlet end and an outlet end, the motor or pump comprising:
a rotor; and
a stator comprising:
a power generating section; and
a gearing section;
the gearing section reacting the loads generated by the power generating section.

27. The assembly of any one of embodiments 24-26, wherein the power generating section and the gearing section form a continuous helical profile.

28. The assembly of any one of embodiments 24-26, wherein the stator further comprises a hydraulic disconnect section intermediate the power generating section and the gearing section.

29. The assembly of embodiment 28, wherein the power generating section and the gearing section form respective portions of a continuous helical profile.

30. The assembly of any one of embodiments 24-29, wherein the gearing section comprises an even wall profile.

31. The assembly of embodiment 30, wherein the even wall profile comprises:
stacked wafers arranged in a cylindrical stator tube to create an inner surface having a helical profile; and
a layer of rubber disposed on the inner surface and having a substantially uniform thickness.

32. The assembly of embodiment 31, wherein the stacked wafers are affixed to the cylindrical stator tube using at least one of an epoxy or an interference fit.

33. The assembly of embodiment 30, wherein the even wall profile comprises:
a molded, cast, or machined insert comprising an inner surface having a helical profile disposed in a cylindrical stator tube; and
a layer of rubber disposed on the inner surface and having a substantially uniform thickness.

34. The assembly of embodiment 33, wherein the insert is affixed to the cylindrical stator tube using at least one of an epoxy, an interference fit, or threading.

35. The assembly of embodiment 30, wherein the even wall profile comprises:
an epoxy composite comprising an inner surface having a helical profile molded, cast, or bonded into a cylindrical stator tube; and
a layer of rubber disposed on the inner surface and having a substantially uniform thickness.

36. The assembly of embodiment 30, wherein the even wall profile comprises:
an integral machined or cast section of a stator tube, the integral section comprising an inner surface having a helical profile; and
a layer of rubber disposed on the inner surface and having a substantially uniform thickness.

37. The assembly of any one of embodiments 24-36, wherein the gearing section comprises a first rubber and the power section comprises a second rubber, wherein the first rubber and the second rubber may be the same or different.

38. The assembly of embodiment 37, wherein the first rubber is harder than the second rubber.

39. The assembly of any one of embodiments 24-38, wherein the gearing section comprises a metal, composite, ceramic, or hard rubber with low to zero interference during operation of the assembly.

40. The assembly of any one of embodiments 24-39, wherein the gearing section is located proximate the distal end of the rotor.

41. The assembly of any one of embodiments 24-39, wherein the gearing section is located proximate the proximal end of the rotor.

42. The assembly of any one of embodiments 24-39, comprising a first gearing section located proximate the distal end of the rotor, a second gearing section located proximate the proximal end of the rotor, and the power generating section intermediate the first and second gearing sections.

43. The assembly of any one of embodiments 24-39, comprising a first gearing section located proximate the distal end of the rotor, a second gearing section located proximate the proximal end of the rotor, one or more gearing sections intermediate the proximal end and distal end of the rotor, and one or more power generating sections intermediate the first a second gearing sections.

44. A method of manufacturing an outer member of a moving or progressive cavity motor or pump, such as a stator, the method comprising:
disposing a layer of a first rubber having a substantially uniform thickness and a helical profile on an inner surface of a first section of the outer member; and
disposing a second rubber having a non-uniform thickness and a helical profile on an inner surface of a second section of the outer member.

45. The method of embodiment 44, further comprising forming an outer member having a first section comprising an inner surface having a helical profile.

46. The method of embodiment 45, wherein the forming comprises at least one of:
stacking wafers in a housing to create an inner surface having a helical profile;
molding, casting, or machining an insert comprising an inner surface having a helical profile and disposing the insert in a cylindrical housing;
molding or casting an epoxy composite comprising an inner surface having a helical profile in a housing;
machining or casting a housing comprising an integral section comprising an inner surface having a helical profile.

47. The method of embodiment 46, wherein the housing is cylindrical.

48. The method of any one of embodiments 44-47, further comprising spacing the layer of first rubber from the layer of second rubber to form a third section hydraulically disconnecting the first and the second sections.

49. The method of any one of embodiments 44-48, wherein the first rubber is harder (less elastic) than the second rubber.

50. The method of any one of embodiments 44-49, wherein the disposing the layer of first rubber and the disposing the layer of second rubber are performed via a continuous injection process.

51. The method of any one of embodiments 44-50, further comprising adjusting a location of the housing to align the helical profile of the first rubber layer with the helical profile of the second rubber layer.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A moving or progressive cavity motor or pump comprising:

a rotor deployed in a stator, the rotor having an outer helicoidal surface; and the stator comprising:

an outer cylindrical housing;

a helicoidal section deployed in the outer cylindrical housing, the helicoidal section having a solid rubber profile and a helicoidal inner surface, the helicoidal section configured to receive the rotor; and at least one ring-shaped insert deployed in the outer cylindrical housing, the at least one ring-shaped insert having a corresponding helicoidal inner surface, the at least one ring-shaped insert having a compressibility that is less than a compressibility of the helicoidal section, the at least one ring-shaped insert configured to constrain lateral movement of the rotor with respect to the stator;

wherein the at least one ring-shaped insert has an axial length in a range from about 2 to about 50 millimeters and the stator has an overall axial length in a range from about 1 to about 10 meters.

2. The motor or pump of claim 1, wherein the at least one ring-shaped insert is sized and shaped to constrain the lateral movement of the rotor relative to the stator to a range of less than 100 microns.

3. The motor or pump of claim 1, wherein the at least one ring-shaped insert is fabricated from a metal.

4. The motor or pump of claim 1, wherein the helicoidal inner surface of the helicoidal section and the corresponding helicoidal inner surfaces of the at least one ring-shaped insert form a continuous internal helicoidal profile.

5. The motor or pump of claim 1, wherein the at least one ring-shaped insert is a single insert deployed at an inlet end or an outlet end of the stator.

6. The motor or pump of claim 1, wherein the at least one ring-shaped insert comprises first and second inserts deployed at axially opposing ends of the stator.

7. The motor or pump of claim 1, wherein the at least one ring-shaped insert comprises first, second, and third inserts, the first and second inserts being deployed at axially opposing ends of the stator and the third insert deployed in a middle section of the stator.

8. The motor or pump of claim 1, wherein the at least one ring-shaped insert comprises a plurality of axial flow channels formed in the corresponding inner helicoidal surfaces thereof.

9. The motor or pump of claim 1, wherein the at least one ring-shaped insert is deployed proximate to an end of the rotor that is configured for coupling with a transmission or drive shaft.

10. A moving or progressive cavity motor or pump comprising:

a rotor deployed in a stator, the rotor having an outer helicoidal surface; and the stator comprising:

an outer cylindrical housing;

first and second helicoidal sections deployed in the outer cylindrical housing, the helicoidal sections having a solid rubber profile and a helicoidal inner surface, the helicoidal sections configured to receive the rotor; and first, second, and third axially spaced, ring-shaped inserts deployed in the outer cylindrical housing, each of the first, second, and third ring-shaped inserts having a corresponding helicoidal inner surface, the first and second ring-shaped inserts deployed axially about the first helicoidal section and the second and third ring-shaped inserts deployed axially about the second helicoidal section, all of the first, second, and third ring-shaped inserts having a compressibility that is less than a compressibility of the helicoidal section and being configured to constrain lateral movement of the rotor with respect to the stator.

11. The motor or pump of claim 10, wherein each of the ring-shaped inserts is sized and shaped to constrain the lateral movement of the rotor relative to the stator to a range of less than 100 microns.

12. The motor or pump of claim 10, wherein each of the ring-shaped inserts has an axial length in a range from about 2 to about 50 millimeters and the stator has an overall axial length in a range from about 1 to about 10 meters.

13. The motor or pump of claim 10, wherein each of the ring-shaped inserts is fabricated from a metal.

14. The motor or pump of claim 10, wherein each of the helicoidal inner surfaces of the first and second helicoidal sections and the corresponding helicoidal inner surfaces of the first, second, and third ring-shaped inserts form a continuous internal helicoidal profile.

15. The motor or pump of claim 10, wherein each of the helicoidal inner surfaces of the first, second, and third ring-shaped inserts is reduced with respect to the helicoidal inner surfaces of the first and second helicoidal sections.

16. The motor or pump of claim 10, wherein each of the ring-shaped inserts comprises a plurality of corresponding axial flow channels formed in the corresponding inner helicoidal surfaces thereof.

17. The motor or pump of claim 10, wherein the first ring-shaped insert is deployed proximate to an end of the rotor that is configured for coupling with a transmission or drive shaft.

18. A moving or progressive cavity motor or pump comprising:

a rotor deployed in a stator, the rotor having an outer helicoidal surface; and the stator comprising:

an outer cylindrical housing;

a helicoidal section deployed in the outer cylindrical housing, the helicoidal section having a solid rubber profile and a helicoidal inner surface, the helicoidal section configured to receive the rotor; and at least one ring-shaped insert deployed in the outer cylindrical housing, the at least one ring-shaped insert having a corresponding helicoidal inner surface, the at least one ring-shaped insert having a compressibility that is less than a compressibility of the helicoidal section, the at least one ring-shaped insert configured to constrain lateral movement of the rotor with respect to the stator;

wherein the helicoidal inner surface of the at least one ring-shaped insert has a reduced helicoidal profile with respect to the helicoidal inner surface of the helicoidal section.

19. The motor or pump of claim 18, wherein the at least one ring-shaped insert is fabricated from a metal.

20. The motor or pump of claim 18, wherein the at least one ring-shaped insert is deployed proximate to an end of the rotor that is configured for coupling with a transmission or drive shaft.

* * * * *